US005560216A

United States Patent [19]

Holmes

[11] Patent Number: 5,560,216

[45] Date of Patent: Oct. 1, 1996

[54] COMBINATION AIR CONDITIONER AND POOL HEATER

[76] Inventor: Robert L. Holmes, 1115 S. Main, Sapulpa, Okla. 74066

[21] Appl. No.: 392,517

[22] Filed: Feb. 23, 1995

[51] Int. Cl.[6] ..... F25D 29/00

[52] U.S. Cl. ..... 62/161; 62/180; 62/238.6

[58] Field of Search ..... 62/180, 182, 181, 62/183, 184, 158, 161, 163, 238.6, 238.7

[56] References Cited

U.S. PATENT DOCUMENTS

| | | | |
|---|---|---|---|
| 3,498,072 | 3/1970 | Stiefel | 62/238.6 X |
| 3,926,008 | 12/1975 | Webber . | |
| 3,976,123 | 8/1976 | Davies | 62/183 X |
| 4,232,529 | 11/1980 | Babbitt et al. . | |
| 4,279,128 | 7/1981 | Leniger . | |
| 4,653,287 | 3/1987 | Martin, Jr. . | |
| 4,667,479 | 5/1987 | Doctor . | |
| 4,907,418 | 3/1990 | DeFazio . | |
| 5,052,187 | 10/1991 | Robinson, Jr. | 62/238.7 X |
| 5,058,392 | 10/1991 | Jouan et al. | 62/238.6 |
| 5,184,472 | 2/1993 | Guilbault et al. . | |

*Primary Examiner*—Harry B. Tanner
*Attorney, Agent, or Firm*—William S. Dorman

[57] ABSTRACT

A combination air conditioner and pool heater. The air conditioner is a conventional house air conditioner which includes a condensing unit located outside the house and comprising a compressor, an air cooled coil, and a external fan directing air across the air-cooled coil; the conventional air conditioner also includes an evaporator unit inside the house, the evaporator unit comprising an evaporator coil and an internal fan for blowing air across the evaporator coil to discharge cool air into the house; the pool being a conventional outdoor swimming pool having a circulating pump for withdrawing water from the pool and for returning water to the pool; combined with the conventional air conditioning system and the conventional swimming pool are a coaxial heat exchanger coil having an outer conduit and an inner conduit disposed in heat exchange relation with each other, a bypass duct is connected from the pump to the outer conduit of the coaxial heat exchanger, the outer conduit being connected to a discharge pipe for discharging water back into the pool, and a pair of valves connected to the compressor for alternately supplying hot compressed liquid to the air-cooled heat exchanger or to the inner conduit of the coaxial heat exchanger coil. Controls are provided for the proper sequencing of the operation of the various instrumentalities and to insure that the external fan is off when refrigerant is passing though the inner conduit of the coaxial heat exchanger.

4 Claims, 4 Drawing Sheets

COMBINATION AIR CONDITIONER AND POOL HEATER

SUMMARY OF THE INVENTION

1. Field of the Invention

The present invention relates to an air conditioning system which is modified to heat the water in a swimming pool by the use of a coaxial heat exchanger which can be placed in the normal flow path of the pump and filter system for a swimming pool. The added coil has two effects: it will heat the water in the pool and will improve the efficiency of the air conditioner within the house, thereby saving operating expenses in both areas.

2. The Prior Art

A preliminary search was conducted on the present invention and the following listed patents were uncovered in the search:

| Inventor | Patent No. | Issue Date |
|---|---|---|
| Webber | 3,926,008 | December 16, 1975 |
| Babbitt, et al. | 4,232,529 | November 11, 1980 |
| Leniger | 4,279,128 | July 21, 1981 |
| Martin, Jr. | 4,653,287 | March 31, 1987 |
| Doctor | 4,667,479 | May 26, 1987 |
| DeFazio | 4,907,418 | March 13, 1990 |
| Guilbault, et al. | 5,184,472 | February 9, 1993 |

The Webber patent shows a water-cooled condenser coil which is placed in the pool itself. The air conditioning system also includes an evaporator within the house, an external compressor, an external air cooled condenser and a fan for the air cooled condenser. The pool is provided with a thermostat. When the temperature of the pool reaches a predetermined value, a first valve will be closed and a second valve will be opened to bypass the water cooled coil. The house is also provided with a thermostat. An external auxiliary evaporator is located externally in the yard. Thus, if the house is cool enough, the internal evaporator is bypassed in favor of the external auxiliary evaporator so that it is possible to continue to heat the pool when the requirements for air conditioning in the house have already been met.

The Babbitt, et al. patent provides results similar to Webber, but in a slightly different manner. In the Babbitt system, a secondary water pump is used to supply water from a reservoir into a water cooled coil.

The Leniger patent shows a system for heating a swimming pool in combination with a heat pump.

The Martin, Jr. patent shows a system for heating and cooling liquids, more particularly, the water in a swimming pool.

The Doctor patent shows an indoor swimming pool and an air conditioning unit which is capable of heating or cooling the air in an enclosure and which is also capable of humidifying the air or heating or cooling the pool.

The DeFazio patent shows a swimming pool heating system in combination with an air conditioning system for a house. The DeFazio unit uses a secondary pump.

The Guilbault, et al. patent shows an add-on device which can be added to most commercially available residential heat pumps used to heat or cool a dwelling; the add-on device makes it possible for the heat pump to be used as a water heater for a swimming pool without the heat pump losing any of its function in the heating and/or cooling of the dwelling. In the Guilbault, et al. system, the heat pump constantly heats the water even if the pool does not require heating.

SUMMARY OF THE INVENTION

The present invention involves a combination air conditioner and pool heater. The air conditioner itself is of the type which is used in a house or home and is essentially conventional. The house air conditioning system includes a condensing unit which is generally located outside the house, the condensing unit comprising a compressor having an inlet for taking a gaseous refrigerant from the house and compressing the same into a hot liquid, the compressor also having an outlet for discharging hot liquid therefrom. The condensing unit also includes an air cooled coil having an inlet for receiving the hot compressed refrigerant from the outlet of the compressor and for cooling the liquid refrigerant. The external condensing unit also includes a condenser fan and fan motor for directing air across the air-cooled coil for cooling the compressed refrigerant therein. Finally, the air conditioning system for the house includes an evaporator unit inside the house, the evaporator unit being connected to the discharge of the air cooled coil and comprising an evaporator coil having an expansion valve mounted in the inlet of the evaporator coil. When the cooled compressed refrigerant from the external air-cooled coil passes through the expansion valve into the evaporator unit in the house, the liquid expands and is cooled rapidly, thus cooling the evaporator coil. A fan within the house will then blow air across the coil of the evaporator unit discharging into the interior of the house to provide cool, air conditioned air.

The outdoor swimming pool is essentially conventional in that the pool will contain a body of water and will also be provided with a circulating pump having an inlet for withdrawing water from the pool and an outlet for returning water from the pump to the pool.

The present invention involves a number of devices or elements in combination with the above described air conditioning system and the above described swimming pool system. For example, a coaxial heat exchanger coil is provided, this coaxial heat exchange coil having an outer conduit and an inner conduit disposed in heat exchange relation with each other. Each conduit is provided with an inlet end and an outlet end. Also, a bypass duct is connected to the outlet from the pump and bypasses the normal discharge from the pump into the pool. That is, this bypass duct leads from the pump to the inlet end of the outer conduit of the coaxial heat exchanger conducting water through the outer conduit. The outlet end of the outer conduit then connects to a discharge pipe for discharging water back into the pool. A pair of solenoid valves are connected to the outlet from the compressor for alternately supplying hot compressed liquid to the air-cooled heat exchanger or to the inner conduit of the coaxial heat exchanger coil. The outlet from the inner conduit of the coaxial heat exchanger connects through a first check valve to a conduit leading to the evaporator coil within the house. The outlet from the coil of the air-cooled heat exchanger connects through a second check valve through a conduit leading to the evaporator coil within the house. A thermostat is provided inside the house to control the temperature of the air which is cooled by the air conditioning system. A condenser relay and a pump sequencer relay, both responsive to the thermostat in the house, are provided for first energizing the pump sequencer relay to turn on the pump and also to send a delayed signal to the condenser relay for turning on the compressor in timed delay relation with the energization of the pump motor. A manual selector switch is provided for controlling the operation of the two solenoids and the two solenoid valves. The manual selector switch is movable to two positions; in the first position, a first solenoid is energized so as to open the first solenoid valve which allows compressed refrigerant to pass from the compressor into the inlet to the inner conduit of the coaxial heat exchanger; in the second position of the manual selector switch, the condenser fan motor is energized and also the second solenoid is energized to open the second solenoid valve to permit the passage of compressed refrigerant from the compressor to the inlet of the air-cooled heat exchanger. It should be noted that the condenser fan motor is in the off position when the first solenoid is energized to direct compressed refrigerant from the compressor to the coaxial heat exchanger.

DETAILED DESCRIPTION OF THE PREFERRED EMBODIMENTS

Figure 1:
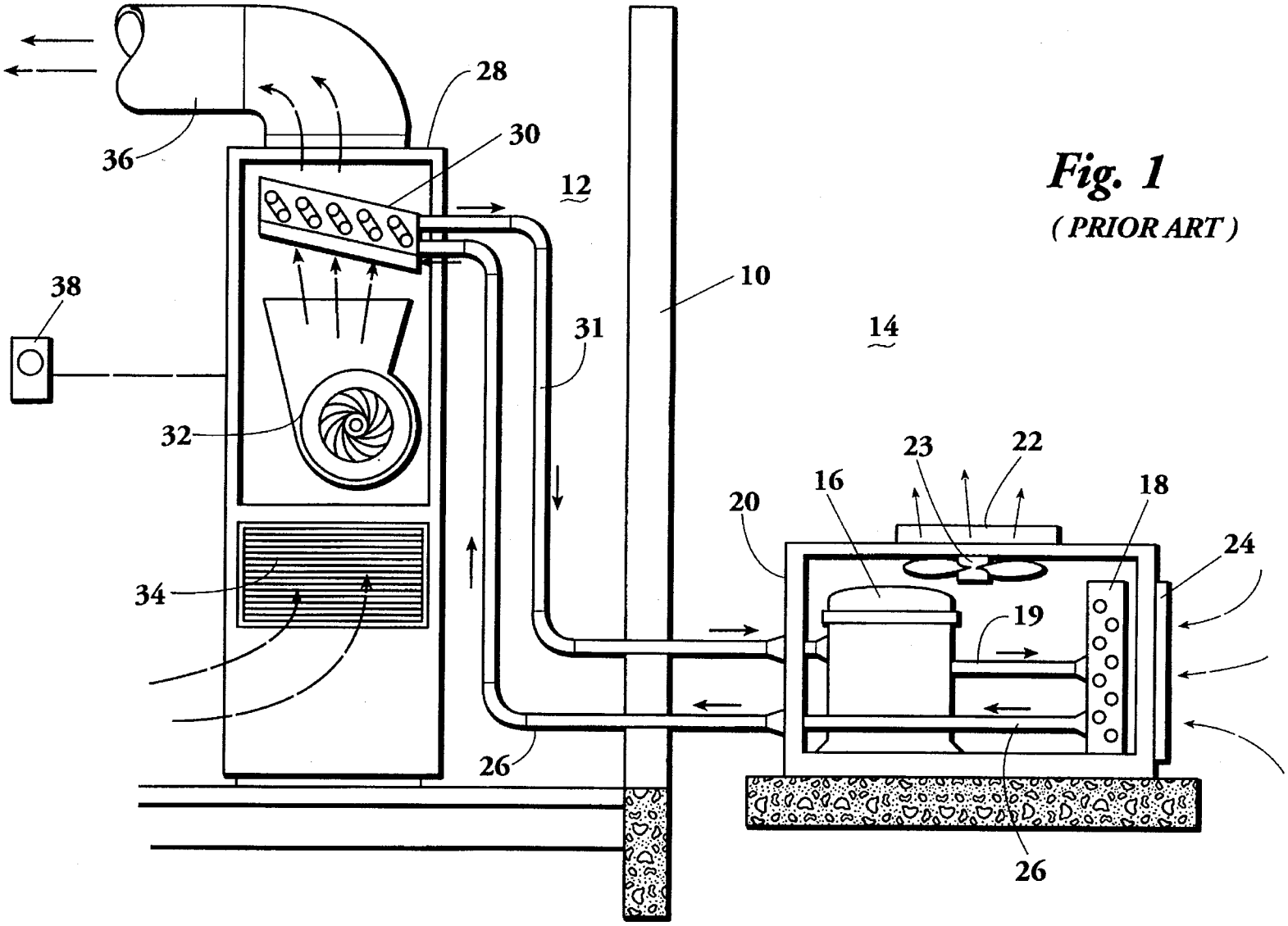
Fig. 1 ( PRIOR ART )
FIG. 1 is a semi-diagrammatic view of a conventional heat exchange system representing the prior art.

Referring to the drawings in detail, FIG. 1 shows a wall 10 separating the interior of a house 12 from the outside or atmosphere 14. On the outside of the house adjacent the wall 10 is a conventional compressor 16 which is adapted to take a compressible cooling fluid, such as FREON (a trademark for a fluorinated hydrocarbon used as a refrigerant), from the inside of the house, compress the gas into a liquid form, and deliver it to an air cooled coil 18 by means of a conduit 19. The compressor 16 and coil 18 will be located inside of an exterior condenser unit 20 on which is also mounted a condenser fan 22. The fan 22 is operated by a condenser fan motor 23, the details of which are considered to be conventional. The unit 20 will be provided with an opening 24 which may include a filter (not shown), if desired. In any event, the fan 22 will suck air into the interior of the housing 20 and through the coil 18 so as to cool the liquid passing into the condensing unit from the compressor 16. Cooled liquid FREON (trademark as indicated above) will pass from the air-cooled coil 18 through a conduit 26 and into the house to the internal air conditioning console 28. The interior console 28 has mounted therein an evaporator unit 30, and a blower or fan 32. An opening duct 34 is provided in the housing 28 so as to allow the blower to suck air into the interior of the housing. An outlet duct 36 is connected to the unit 28, preferably adjacent the top thereof, for conducting cooled air to various parts of the house. An expansion valve (not shown) will be located within the inlet to the evaporator coil of the evaporator unit 30 such that the cooled FREON (trademark as indicated above) liquid, under pressure, will be allowed to expand into the evaporator coil so as to produce cooling under the well known effect. The coils inside the evaporator 30 will thus be cooled by the expanding FREON (trademark as indicated above) gas, and the air that is drawn into the unit from the opening 34 will pass over the cooling coils in the evaporator unit 30 and will be cooled as the air passes into the ductwork 36. The warmed FREON (trademark as indicated above) gas from the evaporator 30 will return to the compressor through the conduit 31. A conventional thermostat 38 will be located at some convenient point in the house for the purpose of turning on the blower 32 and the compressor 16 and fan 22 whenever the temperature inside the house rises above a predetermined value. For the purpose of providing a 24 volt source for the thermostat and other functions (as will hereinafter appear), a transformer (not shown) will be located within the house, preferably in a location at or near the console 28.

Figure 3:
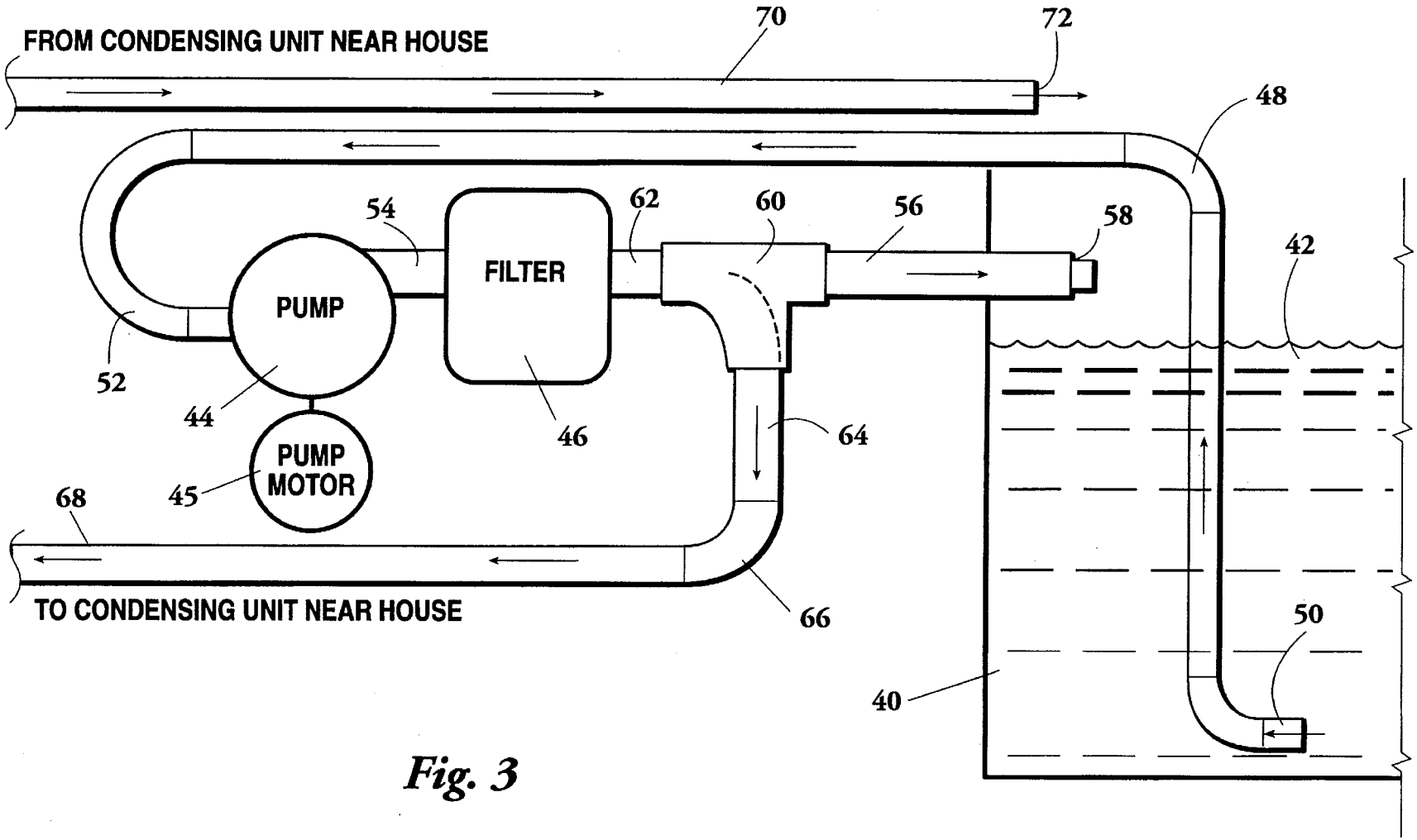
FIG. 3 is a semi-diagrammatic view of the portion of the present invention which connects with the elements adjacent the swimming pool.

Turning now to FIG. 3, there is shown a conventional swimming pool 40 having water 42 therein, a conventional pump 44 connected to a conventional filter 46 and driven by a conventional pump motor 45. The inlet to the pump 44 is connected to conventional piping 48 which has an inlet end 50 adjacent the inner bottom of the pool and whose other end 52 connects to the inlet of the pump. The pump connects to the filter through a short pipe 54, and the filter in turn connects with piping 56 which can allow water to return to the pool through an opening 58. For the purposes of the present invention, the outlet 58 is closed by a plug or by valving (not shown). Optionally, the system shown in FIG. 3 can be provided with a Tee connection 60, one end of which connects with a short piece of pipe 62 to the filter 46, another opening of which connects with the pipe 56 that discharges into the pool, and a third opening of which connects with a vertical pipe 64. Although the vertical pipe 64 is shown in FIG. 3 as having an elbow 66 which connects with a horizontal pipe 68, for purposes of draining the pool the pipe 64 could be a short piece of vertical pipe which would discharge water onto the ground. The swimming pool configuration shown in FIG. 3 is essentially conventional except that it adds a pipe 68 to provide a flow of water to the exterior unit near the house; also a return line 70 from the unit near the house will return water to the pool through the discharge opening 72.

Figure 2:
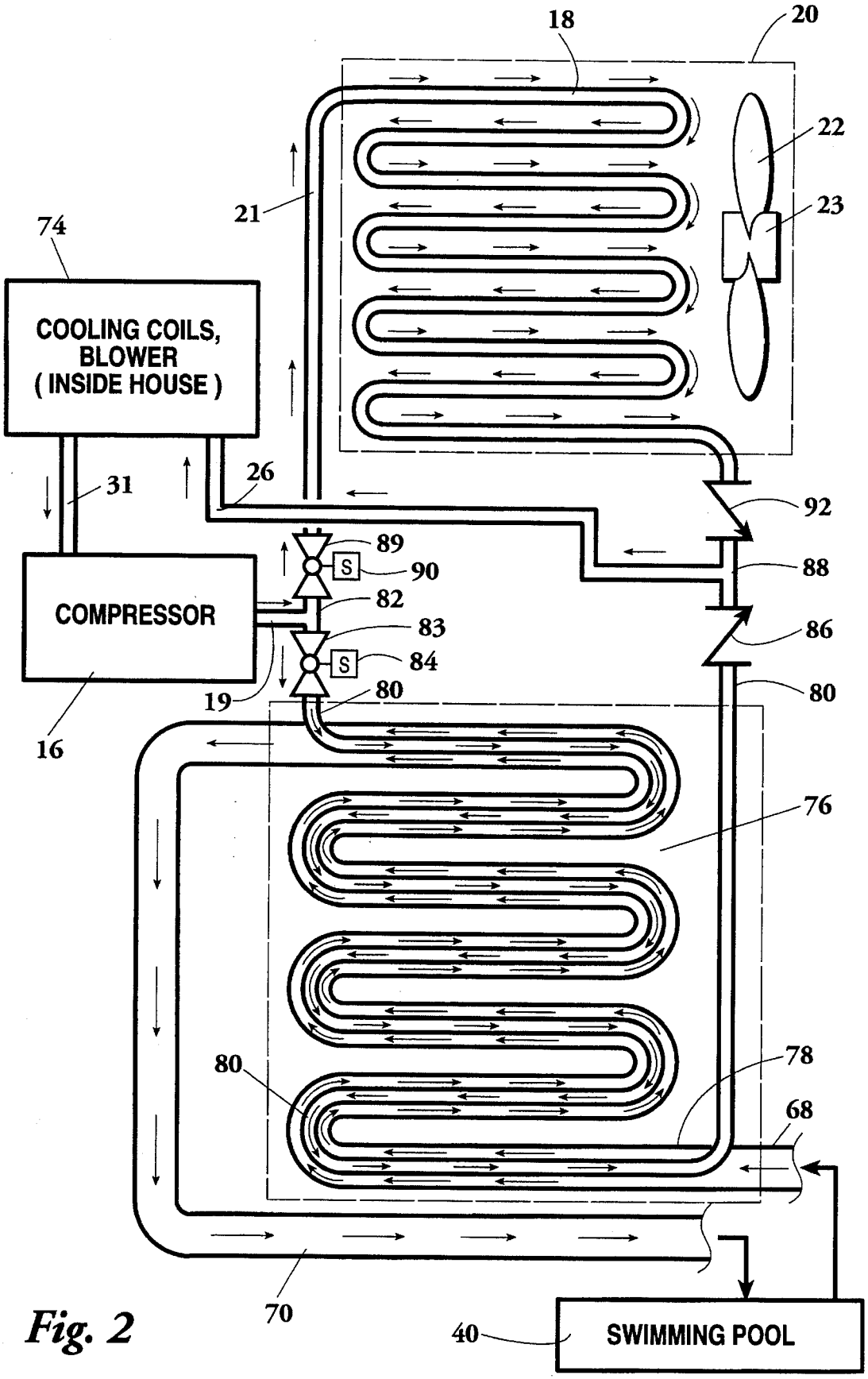
FIG. 2 is a block diagram of most of the components of the present invention.

Turning now to FIG. 2, the elements which are the same as in the prior art of FIG. 1 will bear the same reference numerals. That is, the compressor 16 is the same as the compressor 16 shown in FIG. 1 except for the valving arrangement, as will be explained hereinafter. The air-cooled coil 18 is the same as the air-cooled coil 18 shown in FIG. 1, and the fan 22 is the same as the fan 22 shown in FIG. 1. The block 74 which is labeled "cooling coils, blower (inside house)" would include the evaporator 30 and the blower 32 which are shown in FIG. 1. Also, of course, the unit 74 would have an inlet duct 34 and an outlet duct 36.

The invention shown in FIG. 2 includes an added element, a coaxial heat exchanger 76 which can, for example, be purchased from Edwards Engineering Corp. and which is more fully disclosed and described in U.S. Pat. No. 2,661,525, the details of which are incorporated herein by reference. Suffice it to say that the coaxial heat exchanger has an outside pipe 78 and an inside pipe 80, which are in heat exchange relation with each other. In this particular case, the pipe 68 from the pool will connect with the lower right-hand end of the outer conduit 78 and the return pipe 70 will connect with the upper left-hand end of the conduit 78. As far as the inner conduit 80 is concerned, the upper left-hand end connects with the outlet 19 from the compressor through a Tee 82 and a valve 83. The valve 83 is a solenoid type valve operated by the solenoid 84 and which will open or close either manually or automatically, depending upon the requirements of the pool and/or the interior of the house. The outlet (lower right-hand end) of the inner conduit 80 connects with a check valve 86 which, in turn, connects with a Tee 88, the center portion of which is always in communication with the conduit 26 which passes cooled liquid freon to the evaporator 30 within the house. As shown by the arrows in FIG. 2, the water and freon flow counter-currently within the coaxial heat exchanger 76

The other end of the Tee 82 which connects with the conduit 20 from the compressor 16 connects with a valve 89 which is operated by a solenoid 90. The valve 89 also connects with a conduit 21 which leads to the condensing unit 18. The other end of the condensing unit 18 connects with a check valve 92, which also connects with the Tee 88.

Figure 4:
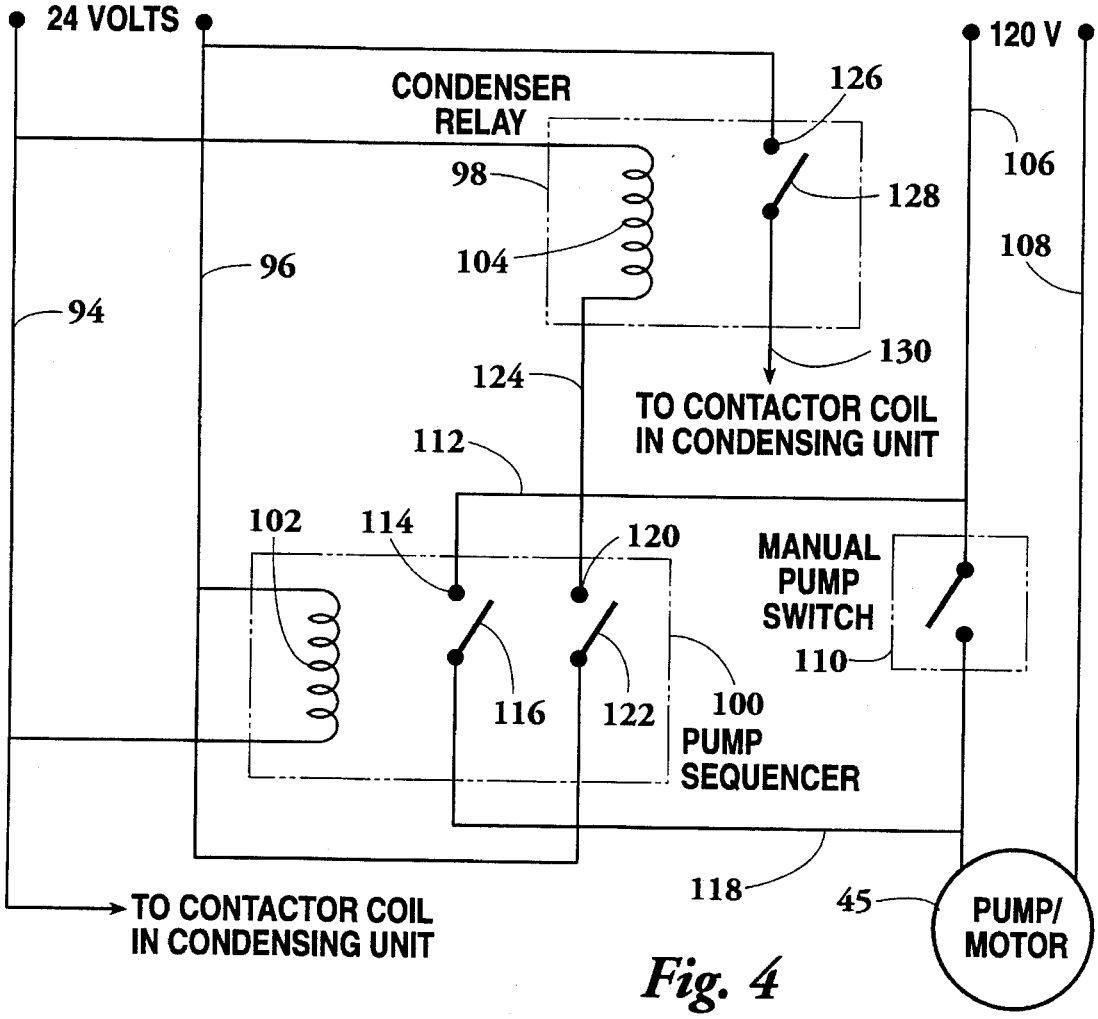
FIG. 4 is an electrical diagram showing connections from the thermostat in the house to a pair of relays turning on the pump and, later, the compressor.

Turning now to FIG. 4, this drawing shows the electrical connections from the 24 volt source from the thermostat within the house. As indicated above, the 24 volts is actually provided by a transformer (not shown) whose output is accessed by the thermostat in a conventional manner. The details of the thermostat have no part of the present invention and, therefore, are not disclosed. However, the thermostat provides, when activated, 24 volts defined by two leads 94 and 96, shown in FIG. 4. The lead 94 is considered the common lead and is generally white, but the color of the lead is immaterial for the purpose of the present invention. The other lead 96 is the "hot" lead which connects directly from the thermostat (not shown) and which is generally red in color. For safety purposes, a high-pressure switch (not shown) is generally connected in series with lead 94 or 96 to shut the air conditioning system down whenever the pressure of the refrigerant exceeds a predetermined value. The pressure of the refrigerant is customarily sensed by a pressure device (not shown) located within the compressor and which controls the operation of the high-pressure switch in a conventional manner.

A pair of relays are provided for the purposes of the electrical circuit shown in FIG. 4. One relay 98 is described as a condenser relay and is essentially a conventional relay. The second relay 100 is referred to as a "pump sequencer" and has one set of contactors therein that are operated in a conventional manner and another set of contactors which are operated on a time delay sequence.

Time delay relays are well known in the art and relay 100 has an operating coil 102 which, as seen in FIG. 4, is connected across the leads 94 and 96 whenever the thermostat sends 24 volts to these relays. Thus, relay 100 is actuated as soon as the thermostat calls for it. Relay 98, however, is provided with a coil 104 which initially is connected only to lead 94.

The circuit shown in FIG. 4 is also utilized in connection with the pump motor 45. To this end a source of 120 volts is provided through a pair of leads 106 and 108. Lead 106 connects, first of all, to the pump motor through a pump switch 110. The other lead 108 connects directly to the pump motor. Thus, if it is desired to turn the pump motor 45 on when there is no command received from the thermostat, the manual pump switch 110 can be closed to turn on the pump motor. However, the manual pump switch is normally left in the open position. Therefore, the line 106 is shown connecting with a line 112 immediately above the manual pump switch 110. The lead 112 connects with a fixed contact point 114 in the pump sequencer 100. A movable contactor 116 in the pump sequencer 100 connects with a line 118 which connects back to the line 106 immediately below the manual pump switch 110. Thus, when the coil 102 of the pump sequencer is energized by a command from the thermostat, the movable contactor 116 will close so as to turn on the pump motor immediately. Within the pump sequencer relay 100 is a second fixed contactor 120 and a second movable contact 122. The lower end of the movable contactor 122 is connected to the "hot" line 96 from the transformer. However, the internal details of the pump sequencer relay 100 are such that the movable contact 122 is delayed in closing with respect to the movements of the other contactor 116 for a period of 45 to 90 seconds. A fixed contact 120 connects with a lead 124 which connects up to one side of the coil 104 in the condenser relay 98. The other end of this coil 104 connects with the lead 94 from the transformer, as indicated previously. Thus, after a period of 45 to 90 seconds, the movable contactor 122 will close against contactor 120 and power will be provided to the other end of the coil 104 and the condenser relay 98 through the line 96, movable contactor 122, stationary contactor 120 and the line 124.

Within the condenser relay 98 is a fixed contact 126 and a movable contactor 128. The movable contactor 128 connects with a line 130 which runs to the contactor coil in the condenser housing 20. As also shown in FIG. 4, the other line 94 from the transformer also connects with the contactor coil in the condenser housing 20. Therefore, when the contactor 120 is closed, the contactors in the condenser housing 20 will turn on the compressor 16, 45 to 90 seconds after the pump motor has been turned on.

Figure 5:
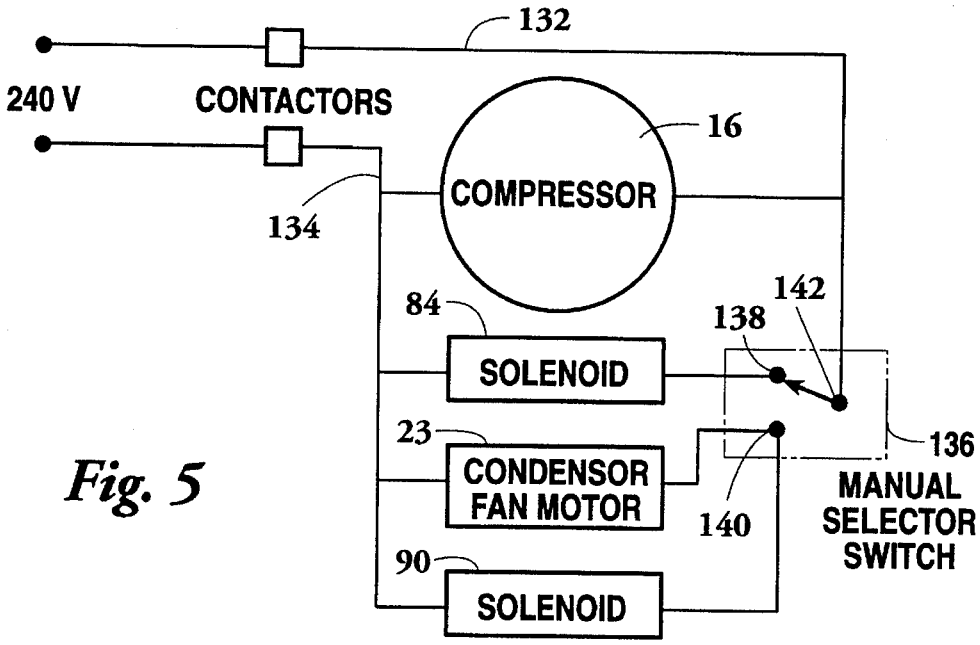
FIG. 5 is an electrical diagram showing connections to the compressor as well as to a manual selector switch which operates the air solenoid and condenser fan motor in one mode, and the water solenoid in a second mode.

As shown in FIG. 5, the 240 volt source passes through contactors and through lines 132 and 134 to opposite sides of the compressor 16. The line 132 also connects with a manual selector switch 136. The manual selector switch has two stationary contacts 138 and 140 and a moveable contactor 142. The fixed end of the moveable contactor 142 connects with the line 132, as indicated above. The fixed contactor 138 connects through the water solenoid 84. Thus, in the position shown in FIG. 5, the water solenoid 84 would be actuated by the 240 volt source to open the valve 83 so that the hot compressed freon flows from the compressor through the heat exchanger 76.

If the water in the pool has become sufficiently warm, or, if for any other reason it is desired to switch to the air cooled unit in the housing 20, then one merely need change the manual selector switch by moving the moveable contact 142 into contact with the stationary contact 140, at which time the solenoid 90 is opened and the condenser fan motor 23 is actuated. In this regard, it will be noted that the condenser fan motor 23 is not on when the water solenoid 84 is open, thus resulting in a savings of the operation of the external fan motor 23. It should also be mentioned that both solenoids 84 and 90 are closed when there is no power to either solenoid. If desired the selector switch 136 could be thermostatically controlled, in which case it would no longer be described as "manual".

What is claimed is:

1. A combination air conditioner and swimming pool heater utilizing a conventional air conditioning system for a house and a conventional outdoor swimming pool wherein the air conditioning system provides a condensing unit outside the house including a compressor having an inlet and an outlet, an air-cooled coil having an inlet and an outlet, a condenser fan for directing air across the air-cooled coil, the air conditioning system also providing an evaporator unit within the house, the evaporator unit having a coil with an inlet and an outlet, an indoor fan for blowing air across the coil of the evaporator unit and into the house to provide cooled air for the house; the conventional outdoor swimming pool containing a body of water and including a circulating pump having an inlet for withdrawing water from the pool and an outlet for returning water from the pump to the pool;

the improvement which comprises a coaxial heat exchanger coil having an outer conduit and an inner conduit disposed in heat exchange relation with each other, a bypass duct connecting from the pump outlet to the outer conduit of the coaxial heat exchanger for conducting water through the outer conduit, a discharge pipe connected to the outer conduit for discharging water into the pool, the compressor being provided with first and second solenoid valves connected to the outlet from the compressor, the first solenoid valve being connected to the inner conduit of the coaxial heat exchanger, the second solenoid valve connecting from the compressor to the inlet for the air cooled heat exchanger, the inner conduit of the coaxial heat exchanger having an outlet connecting through a first check valve to a conduit leading to the evaporator coil within the house, the outlet from the coil of the air-cooled heat exchanger connecting through a second check valve to the conduit leading to the evaporator coil within the house, a thermostat within the house, a condenser relay and a pump sequencer relay, both responsive to the thermostat in the house for first energizing the pump sequencer relay to turn on the pump and to send a delayed signal to the condenser relay for turning on the compressor in time delay relation with the energization of the pump, a manual selector switch being movable to two positions, the manual selector switch, upon being moved to a first position, energizing a first solenoid which opens the first solenoid valve allowing compressed refrigerant to pass from the compressor into the inner conduit of the coaxial heat exchanger, the manual selector switch, when turned to the second position, actuating the condenser fan and actuating a second solenoid to operate the second solenoid valve to permit the passage of compressed refrigerant from the compressor to the inlet of the air-cooled heat exchanger, the condenser fan being off when the first solenoid is energized.

2. A combination air conditioner and swimming pool heater as set forth in claim 1 wherein the water and the compressed refrigerant from the compressor flow countercurrently through the coaxial heat exchanger coil.

3. In combination with an air conditioning system for a house wherein the air conditioning system includes a condensing unit outside the house, the condensing unit comprising a compressor having an inlet for taking a gaseous refrigerant from the house and compressing the same into a liquid, the compressor having an outlet for discharging liquid refrigerant therefrom, the condensing unit also including an air-cooled coil having an inlet for receiving the liquid from the outlet of the compressor and for cooling the same, the air-cooled coil having an outlet for discharging cooled liquid refrigerant, the condensing unit also including a condenser fan for directing air across the air-cooled coil for cooling the compressed refrigerant therein; the air conditioning system having an evaporator unit within the house, the evaporator unit having a coil with an inlet and an outlet, an expansion valve being located at the inlet to the evaporator coil, the inlet from the evaporator unit being connected to the outlet of the air-cooled coil whereby cooled liquid refrigerant can pass through the expansion valve into the evaporator coil to evaporate and to provide cooled gaseous refrigerant within the evaporator unit, the outlet of the evaporator coil being connected to the inlet of the compressor, an indoor fan for blowing air across the coil of the evaporator unit and into the house to provide cooled air for the house;

and in combination with an outdoor swimming pool which contains a body of water, a circulating pump having an inlet for withdrawing water from the pool and an outlet for returning water from the pump to the pool;

the improvement which comprises a coaxial heat exchanger coil having an outer conduit and an inner conduit disposed in heat exchange relation with each other, the outer conduit having an inlet end and an outlet end, the inner conduit having an inlet end and an outlet end, a bypass duct leading from the pump to the inlet end of the outer conduit of the coaxial heat exchanger for conducting water through the outer conduit, the outlet end of the outer conduit of the coaxial heat exchanger connected to a discharge pipe for discharging water into the pool, the compressor being provided with first and second solenoid valves connected to the outlet from the compressor, the first solenoid valve being connected to the inlet of the inner conduit of the coaxial heat exchanger, the second solenoid valve connecting from the compressor to the inlet for the air cooled heat exchanger, the outlet from the inner conduit of the coaxial heat exchanger connecting through a first check valve to a conduit leading to the evaporator coil within the house, the outlet from the coil of the air-cooled heat exchanger connecting through a second check valve to the conduit leading to the evaporator coil within the house, a thermostat within the house, a condenser relay and a pump sequencer relay, both responsive to the thermostat in the house for first energizing the pump sequencer relay to turn on the pump and to send a delayed signal to the condenser relay for turning on the compressor in time delay relation with the energization of the pump, a manual selector switch being movable to two positions, the manual selector switch, upon being moved to a first position, energizing a first solenoid which opens the first solenoid valve allowing compressed refrigerant to pass from the compressor into the inlet to the inner conduit of the coaxial heat exchanger, the manual selector switch, when turned to the second position, actuating the condenser fan and actuating a second solenoid to operate the second solenoid valve to permit the passage of compressed refrigerant from the compressor to the inlet of the air-cooled heat exchanger, the condenser fan being off when the first solenoid is energized.

4. The improvement as set forth in claim 3 wherein the water and the compressed refrigerant from the compressor flow countercurrently through the coaxial heat exchanger coil.

* * * * *